United States Patent [19]

Drzymkowski et al.

[11] Patent Number: 4,606,598

[45] Date of Patent: Aug. 19, 1986

[54] GROUNDING PLATE CONNECTOR

[75] Inventors: Francis A. Drzymkowski, Laguna Niguel, Calif.; Kenneth B. Turnbaugh, Mesa, Ariz.

[73] Assignee: ITT Corporation, New York, N.Y.

[21] Appl. No.: 729,836

[22] Filed: May 2, 1985

[51] Int. Cl.[4] ..... H01R 4/66

[52] U.S. Cl. ..... 339/147 R; 333/182

[58] Field of Search ..... 339/14 R, 143 R, 147 R; 333/182, 183, 185

[56] References Cited

U.S. PATENT DOCUMENTS

| | | | |
|---|---|---|---|
| 3,002,162 | 9/1961 | Garstang | 333/183 X |
| 4,144,509 | 3/1979 | Boutros | 339/147 R X |
| 4,262,268 | 4/1981 | Shimada et al. | 333/182 |
| 4,329,665 | 5/1982 | Kawai et al. | 339/147 R X |

*Primary Examiner*—Eugene F. Desmond

*Attorney, Agent, or Firm*—T. L. Peterson; R. C. Turner

[57] ABSTRACT

A connector is described which holds many contacts, and which can provide a direct ground connection to a contact, or provide a capacitive coupling between the contact and ground, in a rugged and simple construction. The connector includes a thick metal grounding plate attached to a metal shell that forms most of the outside of the connector. A dielectric layer lies on a face of the grounding plate and is covered by a metal overlayer to form a capacitor. A pin contact is connected to the overlayer by means of an insulator which has a plated-through hole engaged with the pin contact. The insulator also has a plated surface in facewise contact with the overlayer, to provide a capacitive coupling between the pin contact and the grounding plate. The grounding plate can have a hole plated with a softer material, and another pin contact can displace some of the softer material to lie in good contact with the grounding plate.

12 Claims, 7 Drawing Figures

GROUNDING PLATE CONNECTOR

BACKGROUND OF THE INVENTION

Connectors with multiple pin contacts may include capacitors for filtering out high frequency noise passing through some of the pin contacts. The connectors may also provide a direct ground connection for a pin contact, and may allow signals to pass through a contact without grounding or capacitive filtering. A number of different arrangements have been proposed, which involve the need for soldering and other relatively difficult operations, and which result in a connector of only moderate reliability and strength which cannot withstand abuse. A connector which could contain numerous pins in a connector of small size, with selected pins being capacitively filtered, grounded, or neither filtered nor grounded, all in an arrangement which enabled relatively low cost and very rugged fabrication and repair, would be of considerable value.

SUMMARY OF THE INVENTION

In accordance with one embodiment of the present invention, a connector is provided which is rugged and of relatively simple design. One connector includes a ground plate device and an insulator device lying adjacent to one another and having aligned holes. The insulator device has a metal plated surface extending to a plated hole. A layer of dielectric material lies on one of the devices and a metal overlayer lies over it. The insulator and grounding plate are in facewise contact so that when a pin contact engages the plated hole of the insulator, it is coupled through the capacitor fromed by the dielectric to the grounding plate. The grounding plate can be formed of hard metal and coated with a softer metal that plates one of its holes, so a pin contact can displace some of the softer metal in the hole to make good contact with the grounding plate.

The novel features of the invention are set forth with particularity in the appended claims. The invention will be best understood from the following description when read in conjunction with the accompanying drawings.

DESCRIPTION OF THE PREFERRED EMBODIMENT

Figure 2:
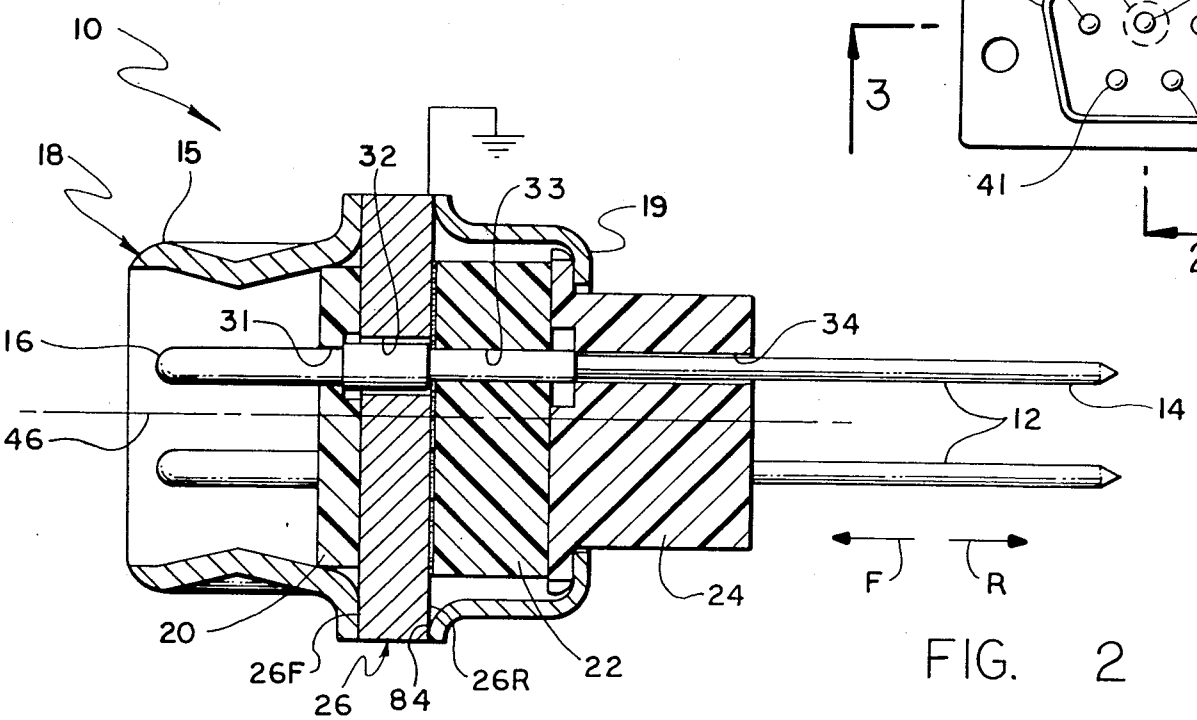
FIG. 2 is a view taken on the line 2—2 of FIG. 1.

FIG. 2 illustrates a connector 10 which includes a group of pin contacts 12 which can carry electricity, such as in the form of signals of low power, between their rearward and forward ends 14, 16. The connector includes a shell device 15 comprising two shell halves or shells 18, 19, surrounding much of the connector, and three insulators 20, 22, and 24 which can serve to hold the contacts in position. This connector includes a metal grounding plate 26 which is electrically grounded and which lies between the shell halves and is securely fastened to them. The electrically grounded plate 26 facilitates the capacitive coupling of some of the contacts to ground, to filter out high frequency noise which may be induced in a contact by external electromagnetic or electrostatic radiation. The grounding plate also permits the direct grounding of a contact where that is desired. The insulators include a forward insulator 20 lying adjacent to a flat forward face 26F of the grounding plate, a rearward insulator 22 lying adjacent to a flat rearward face 26R of the plate, and a backup insulator 24 lying behind the rearward insultor.

Figure 1:
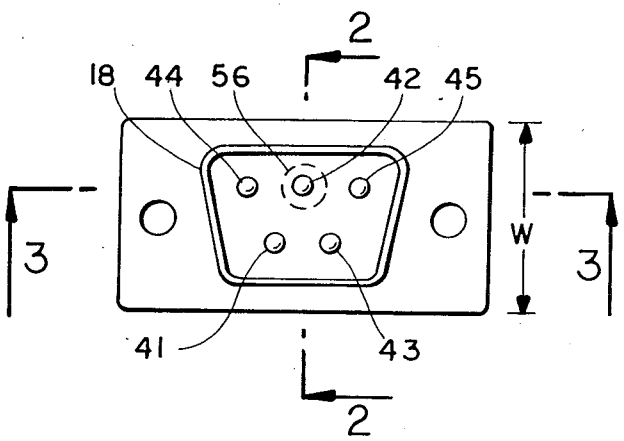
FIG. 1 is a front elevation view of a connector constructed in accordance with one embodiment of the present invention.

The insulators and grounding plate have aligned holes 31–34 through which each contact passes. As shown in FIG. 1, this particular connector has five elongated contacts of which three 41–43 are capacitively coupled to ground through the connector, of which one 44 is directly connected to ground through the connector, and of which one 45 is neither directly nor capacitively coupled to ground. The contacts extend parallel to a lengthwise axis 46 which extends in forward and rearward directions indicated by arrows F and R (FIG. 2).

Figure 3:
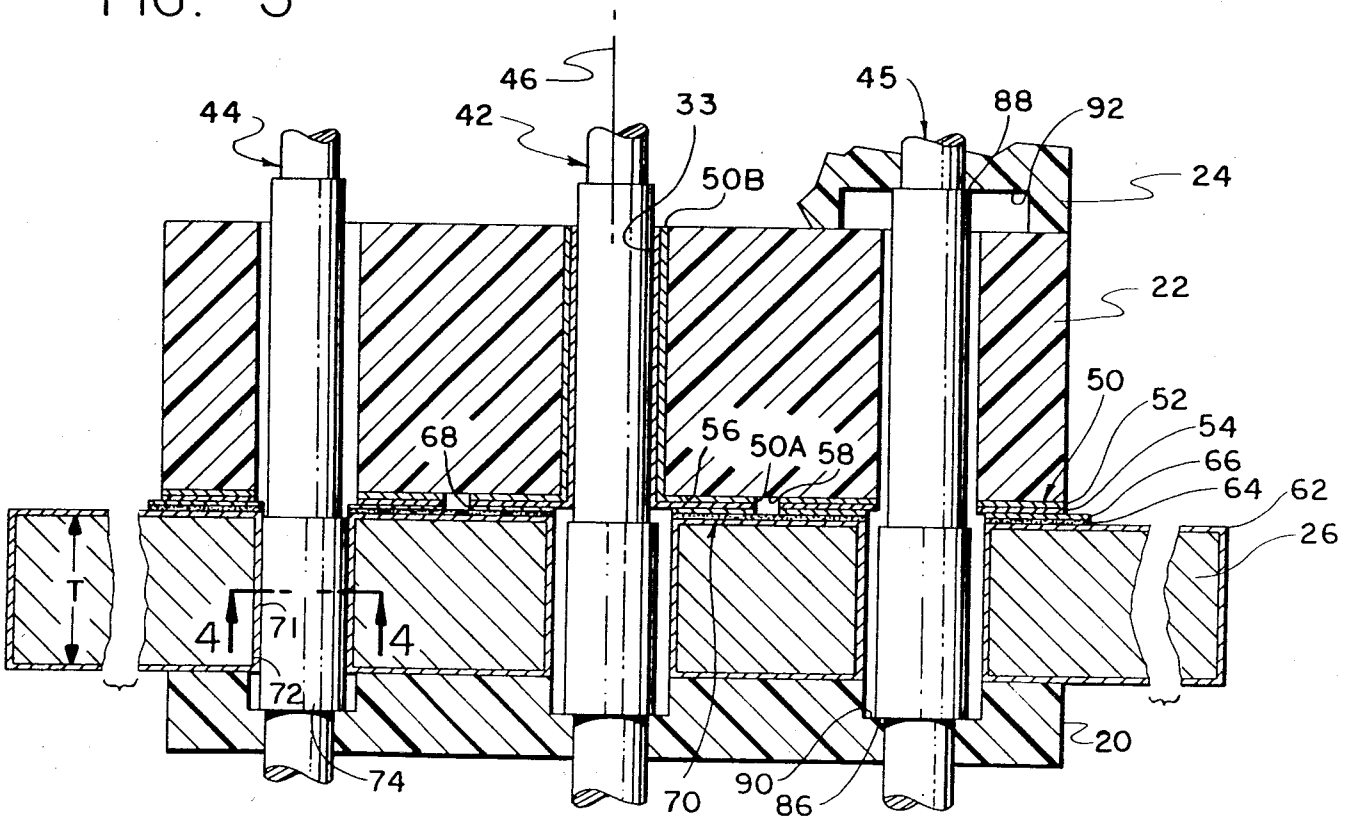
FIG. 3 is a view taken on the line 3—3 of FIG. 1.

FIG. 3 shows three of the contacts 44, 42, and 45. As mentioned above, the middle contact 42 is capacitively coupled to ground. The rearward insulator 22 includes a plating layer 50 which is formed by a copper plating 52 lying directly on the insulator and a solder layer 54 over the copper layer. The plating layer 50 includes a portion 50A which covers a region 56 on a face 58 of the insulator. The region 56 surrounds a hole 33 which closely receives one of the contacts 42. The plating layer also includes a portion 50B contiguous with the portion 50A and which plates the hole 33. The pin 42 is in firm contact with the walls of the hole 33 so they are electrically connected.

Figure 4:
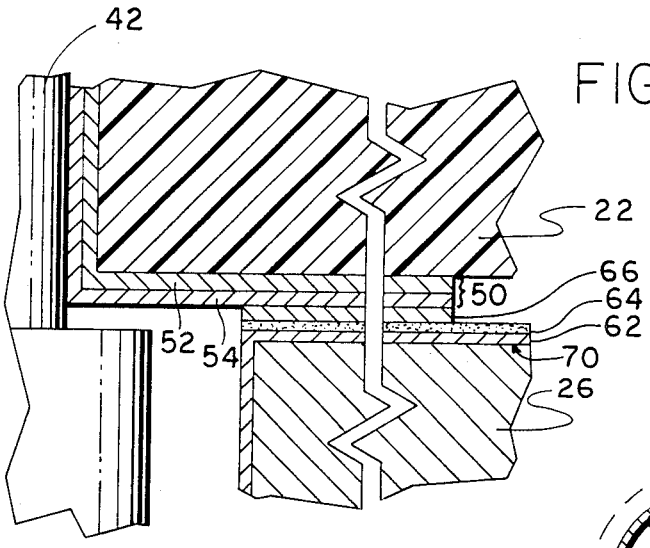
FIG. 4 is an enlarged view of a portion of FIG. 3.

As also shown in FIG. 4, the grounding_plate 26 carries a softer layer 62 and the grounding plate and softer layer may together be referred to as a grounding plate device. A dielectric layer 64 lies over and is bonded to the softer layer, and an overlayer 66 lies over and is bonded to the dielectric layer. The sandwich formed by the overlayer 66, dielectric layer 64 and the softer layer 62 on the grounding plate form a capacitor. Referring again to FIG. 3, the diameter of the capacitor 70 around the contact 42 is limited by a gap 68 in the overlayer around the region 56. The insulator 22 and grounding plate 26 are pressed face-wise towards one another, so that the plating layer 50 on the insulator makes good wide area contact with the overlayer 66 on the grounding plate, at least in the region 56, but they are not bonded to each other. The pin contact 42 is connected through the plating layer portions 50B and 50A to the overlayer 66 in the region 56, so that it is capacitively coupled to the grounding plate 26. As a result, any sharp spikes of voltage induced in the pin contact 42 by either electromagnetic or electrostatic radiation, will be filtered out by the capacitor at 70 formed by the sandwich of the overlayer 66, dielectric 64, and the soft layers 62 on the grounding plate. It is possible to not use the softer layer 62, in which case the dielectric layer can be deposited directly on the grounding plate 26 if the plate is of a conductive material. It may be noted that the overlayer 66 is deposited on the dielectric layer to assure direct contact everywhere with the dielectric layer so the capacitance is predictable and does not vary if the connector is vibrated.

Figure 5:
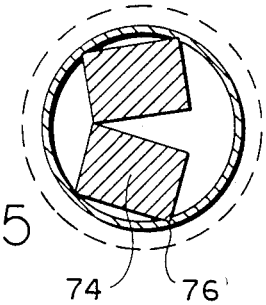
FIG. 5 is a view taken on the line 4—4 of FIG. 3 shown with a form of pin contact that can be used.
Figure 6:
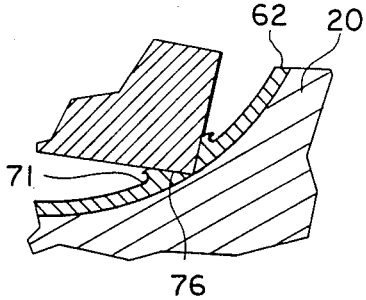
FIG. 6 is an enlarged view of a portion of FIG. 4.

FIG. 3 shows another contact 44 which is grounded by connection at a softer layer portion 71 which plates a hole 72 in the grounding plate. The contact 44 has a portion 74 lying in the hole in interference contact therewith, and displaces some of the softer layer portion 71 on the walls of the hole. FIG. 5 shows the general shape of one form of a pin contact of a type which is disclosed in U.S. Pat. No. 4,296,390. FIG. 6 shows how an edge 76 of the contact displaces part of the soft layer 62 to make good electrical connection with the grounding plate 20. The grounding plate material is harder then the material of the pin contact.

FIG. 3 shows another pin contact 45 which is neither capacitively nor directly connected to ground, so that even high frequency signals can pass through the pin contact 45. In one connector of this type which includes twenty-five contacts, twenty-three are filtered contacts that are capacitively coupled to ground, one is directly grounded, and one is a feed-through contact which may carry power and which is neither capacitively nor directly grounded.

The connector shown in FIG. 2 includes forward and rearward shell halves or shells 18, 19 having ends that are rigidly attached to the peripheral portion 84 of the grounding plate 26 as by welding to form a reinforced housing. The shells surround regions lying beyond the faces of the grounding plate. The grounding plate 26 has a considerable thickness T (FIG. 3) compared to its width W (FIG. 1), so that the grounding plate serves as the main reinforcing member of the connector to provide considerable ruggedness. Also, this can assure flat surfaces or faces on the plate. In one example, the grounding plate has a width W such as $1\frac{1}{2}$ inches and a thickness T of 50 mil (1 mil equals 0.001 inch) so the plate has a thickness greater than one-fiftieth its width (i.e., over 2% of W). For a grounding plate of structural metals, this thickness-to-width ratio provides considerable strength, so the grounding plate can serve as a major structural component that resists bending and adds ruggedness to the connector. For a five contact connector the plate may have a length such as 4 inches.

In a connector that has been constructed, the grounding plate 26 which had a thickness of 50 mil, was constructed of beryllium-copper, and the softer coating 62 was formed of palladium-silver. The dielectric layer 64 was formed of barium titanate, and the overlayer 66 was formed of palladium silver. The plating layer 50 on the insulator 22 included a solder layer 54 of silver solder and the layer 52 of copper. Each pin contact such as 45 had a pair of shoulders 86, 88 which abutted corresponding shoulders 90, 92 on the forward insulator 20 and backup insulator 24. The capacitor 70 had a capacitance of 1000 microfarads.

Figure 7:
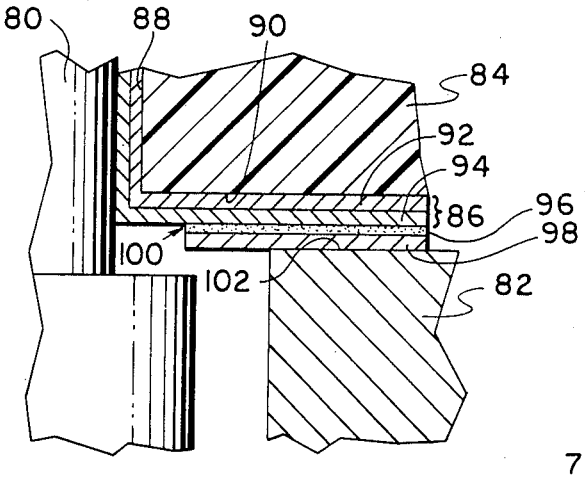
FIG. 7 is a partial enlarged view of another embodiment of the invention.

FIG. 7 illustrates a portion of another connector with a contact 80 that is to be capacitively coupled to a ground plate 82. An insulator 84 has a plating 86 in a hole 88 and on a surface 90, formed of a copper layer 92 and a solder layer 94. The dielectric layer 96 is formed on the plating 86 and a conductive overlayer 98 is formed on the dielectric layer to form a capacitor 100. The insulator with these layers is pressed against a face 102 of the grounding plate.

Thus, the invention provides a compact and rugged connector which enables capacitive coupling of at least one pin contact to a ground connection. Such capacitive coupling can be achieved by the use of a grounding plate and an adjacent insulator. A softer metal layer can be formed on the insulator. A dielectric layer is formed over the grounding plate or over the metal layer on the insulator and a metal overlayer is formed over the dielectric layer to form a capacitor. An electrical connection is made between a plated hole in the insulator and the grounding plate through the capacitor. A thick grounding plate can be used which forms a major structural member of the connector and to which the shell of the connector is rigidly attached. The grounding plate can include hard metal which is plated with a softer metal so that a pin contact which is to be directly grounded can connect to the plate by displacing some of the softer metal which plates a hole of the grounding plate.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A connector comprising:

a metal grounding plate having a plurality of holes, and having forward and rearward faces;

an insulator lying adjacent to one of said faces, said insulator having a plurality of holes aligned with said holes in said plate and said insulator having faces;

a plurality of metal contacts extending through said aligned holes in said plate and insulator;

a plating layer of conductive material lying on the face of said insulator which lies adjacent to said grounding plate, said layer plating at least one of the holes in said insulator, a first of said contacts engaged with said plating layer in said hole but out of contact with the walls of a corresponding hole in said grounding plate; and a layer of dielectric material lying between said plating layer and said grounding plate to form a capacitor between them.

2. The connector described in claim 1 including:

a softer layer of metal which is softer than the material of said grounding plate and coating at least the walls of one of said holes of said plate; and a second of said contacts lying in said plated hole of said plate and in interference contact with said softer layer.

3. The connector described in claim 1 wherein:

said dielectric material is formed as a substantially continuous layer over a face of said grounding plate; and including a metal overlayer lying on and bonded to a face of said dielectric layer that is opposite said grounding plate, said overlayer having a first portion lying in an area around the hole in the grounding plate through which said first contact extends but said first overlayer portion ending a distance from another hole in said plate;

said plating layer on said insulator being in facewise contact with said metal overlayer.

4. The connector described in claim 1 wherein:

said grounding plate has a peripheral portion and including a metal shell device rigidly attached to said peripheral portion and surrounding regions lying beyond said forward and rearward faces.

5. The connector described in claim 4 wherein:

said shell device includes forward and rearward shells fixed to opposite faces of said grounding plate.

6. A connector assembly comprising:

a metal ground plate having a predetermined width and having a sufficient thickness so the plate is rigid against bending, said plate having forward and rearward faces and having a plurality of through holes;

a shell device mounted to said ground plate and surrounding areas lying forward and rearward of said ground plate;

a pair of insulators lying respectively forward and rearward of said ground plate and surrounded by said shell device, said insulators having holes aligned with said holes in said ground plate;

a plurality of metal contacts extending through said aligned holes;

said metal ground plate formed of a hard metal, and including a plating of a softer metal lying at least on the walls of one of said holes of said ground plate, and at least one of said contacts being in interference fit with the plated hole of the ground plate, said one contact having at least one edge that displaces said softer metal to make electricl connection through it to said hard metal ground plate.

7. The connector assembly described in claim 6 wherein:

said plate has a substantially flat face and has a thickness at least about 2% of its width, whereby to retain its flat shape.

8. The connector assembly described in claim 6 including:

a layer of dielectric material lying over and carried by a first face of said ground plate in a region that surrounds a second of said holes, and an overlayer of metal that plates a face of said layer of dielectric material which is opposite said ground plate;

a first of said insulators having a metal layer on a face thereof closest to said ground plate and having a plated hole in electrical connection with said metal layer, said metal layer on said first insulator being in facewise contact with said overlayer; and a second one of said contacts is in contact with the plating on said plated hole of said insulator but out of contact with said ground plate.

9. A connector comprising:

a metal grounding plate device having opposite faces and having a first face with a conductive surface;

an insulator device in the form of a plate of insulation material with an insulator face lying adjacent to said first grounding plate device face, said plate and insulator devices having aligned holes, said insulator device having a metal plating on the walls of a first of said holes therein and on a region of its face which surrounds said hole with the platings on the hole and face region being in electrical connection, said plating on said insulator face forming a conductive surface;

a layer of dielectric material lying on and bonded to a selected conductive surface of a first of said devices at a region adjacent to one of said holes, and a metal overlayer lying on and bonded to a face of said dielectric layer which is opposite said selected conductive surface, said overlayer being in facewise contact with the conductive surface of the second of said devices;

a contact extending through a pair of said aligned holes, said contact in contact with the walls of said plated hole of said insulator device and out of contact with the walls of the corresponding holes of said grounding plate device.

10. The connector described in claim 9 wherein:

said grounding plate device includes a metal plate of hard material and a plating of a material softer than said hard material covering at least one hole of said plate;

a second contact extending through said at least one hole of said plate, and through an aligned hole in said insulator device, said second contact displacing some of said softer material in said hole of said plate to lie in area contact therewith.

11. The connector described in claim 9 wherein:

said selected conductive surface is the conductive surface of said grounding plate device, and said layer of dielectric material lies on said first face of said grounding plate device.

12. The connector described in claim 9 wherein:

said selected conductive surface is the conductive surface of said plating on said insulator face, and said layer of dielectric material lies on a surface of said plating which is opposite said plate of insulation material.

* * * * *